US009409581B2

(12) United States Patent
Ruebusch et al.

(10) Patent No.: US 9,409,581 B2
(45) Date of Patent: Aug. 9, 2016

(54) KNUCKLE DESIGN AND SYSTEM OF MAKING

(71) Applicants: Richard Ruebusch, Columbus, OH (US); Joseph Patterson, Columbus, OH (US)

(72) Inventors: Richard Ruebusch, Columbus, OH (US); Joseph Patterson, Columbus, OH (US)

(73) Assignee: Columbus Steel Castings Company, Columbus ( * ) Notice: Subject to any disclaimer, the term of this patent is extended or adjusted under 35 U.S.C. 154(b) by 182 days.

(21) Appl. No.: 13/941,049

(22) Filed: Jul. 12, 2013

(65) Prior Publication Data

US 2015/0017323 A1 Jan. 15, 2015

(51) Int. Cl.

| | |
|---|---|
| ***C21D 7/06*** | (2006.01) |
| ***B61G 7/00*** | (2006.01) |
| ***B22C 3/00*** | (2006.01) |
| ***B22C 9/02*** | (2006.01) |
| ***B22C 9/10*** | (2006.01) |
| ***B22D 31/00*** | (2006.01) |

(52) U.S. Cl.

CPC ... *B61G 7/00* (2013.01); *B22C 3/00* (2013.01); *B22C 9/02* (2013.01); *B22C 9/10* (2013.01); *B22D 31/002* (2013.01); *Y10T 29/49716* (2015.01)

(58) Field of Classification Search

CPC ..... B24C 1/10; C21D 7/06; B24B 39/006; B21D 31/06; B61G 7/00; Y10T 29/49716

USPC ..... 72/53

See application file for complete search history.

(56) References Cited

U.S. PATENT DOCUMENTS

| | | | | |
|---|---|---|---|---|
| 5,461,987 | A * | 10/1995 | Nassar | 105/167 |
| 5,582,307 | A | 12/1996 | Hawthorne et al. | |
| 6,315,646 | B1 * | 11/2001 | Hoyashita | 72/53 |
| 7,946,009 | B2 | 5/2011 | Dixon et al. | |
| 8,297,455 | B2 | 10/2012 | Smyth | |
| 8,302,790 | B2 | 11/2012 | Dumey | |
| 9,038,836 | B1 * | 5/2015 | Tavares | B61G 3/04 213/154 |

* cited by examiner

*Primary Examiner* — David B Jones

(74) *Attorney, Agent, or Firm* — Standley Law Group LLP

(57) ABSTRACT

Railcar coupling knuckles having areas of improved structure, improved surface characteristics, and reduced stress under loading, and systems and methods for shot peening railcar components such as, but not limited to, coupling knuckles. Such shot-peening systems and methods may include robotic and/or fixed-position shot-peening devices equipped with shot-emitting mechanisms for expelling shot media against desired areas of a railcar component.

18 Claims, 19 Drawing Sheets

KNUCKLE DESIGN AND SYSTEM OF MAKING

TECHNICAL FIELD

The present invention is directed to systems and processes for manufacturing transportation system components such as, but not limited to, coupling knuckles.

BACKGROUND

One of skill in the art would understand that transportation system coupling components, such as knuckles and coupler heads used in railcar applications, are critical components from the standpoint of both functionality and safety. With respect to functionality, these components must be designed and constructed in a manner that ensures proper repeated coupling of one railcar to another. Secure coupling of one railcar to another must, of course, also be maintained until deliberately released.

Coupling is typically accomplished by moving a trailing railcar such that the coupling assembly thereof is brought into engaging contact with the coupling assembly of an immediately leading railcar. Because of the mass of a typical railcar, significant stresses may be imparted to the railcar coupling components during this process. Similarly, once engaged, railcar coupling components may also be subjected to significant stresses upon placing a train of railcars into motion, during motion, and upon the deceleration and stopping of the train. These stresses may be mechanical in nature, such as impact, tension or shearing forces that may be produced during railcar coupling and decoupling, or vibratory in nature, such as may occur during the rolling movement of a railcar. Similar mechanical stresses may also be placed on the coupling components of a moving train of railcars as accelerations and decelerations of the train impart tension or compression forces to the coupling components of adjacent railcars.

As should be obvious, the failure of a railcar coupling assembly, particularly while a train of railcars is in motion, could be catastrophic. Therefore, from the standpoint of safety, railcar coupling components must be designed and manufactured so as to prevent such stresses from causing component damage or failure.

To this end, the Association of American Railroads (AAR) adopted a new standard in 2008 for the fatigue testing of Type E and Type F railcar knuckles. This standard, designated as Specification M-216, requires fatigue testing of four knuckles. M-216 also specifies that the average life of the four knuckles subjected to fatigue testing must exceed 600,000 cycles, and that no individual knuckle tested shall exhibit a life below 400,000 cycles. Therefore, the need to produce railcar knuckles of high strength and durability is apparent.

Railcar knuckle design is constrained by the requirement that knuckles be interchangeable with other manufacturer's knuckles. The result is that within a given standard (such as AAR Type E and Type F), a knuckle must have essentially the same external dimensions and characteristics. This means that an inventor may not simply make the knuckle larger to increase strength. A number of railcar knuckle designs have been proposed over the years with the goal of improving knuckle strength and durability. Examples of other exemplary railcar knuckle designs may be found for example, in U.S. Pat. Nos. 5,582,307; 8,297,455; and 8,302,790.

Nonetheless, it has been found during experimentation and testing, especially testing in association with the AAR M-216 standard, that knuckles of known design tend to fail in a predictable manner. More particularly, it has been discovered that railcar knuckles of known design tend to repeatedly fail in certain areas, namely the tail, throat and pivot pin hole areas. It would, therefore, be desirable to redesign existing railcar knuckles within acceptable parameters and/or to develop improved manufacturing processes so as to increase railcar knuckle strength and durability and mitigate such failures. The invention is so directed.

SUMMARY

One aspect of the invention is directed to improvements in railcar knuckle design. More particularly, embodiments of the invention include improvements to railcar knuckle design in at least the areas thereof that tend to fail most frequently.

Pivot Hole Modifications

One such design improvement relates to reducing the occurrence of knuckle failure near the pivot pin hole. As is known in the art, cores are placed within casting molds prior to the introduction of molten metal to the casting molds. When placed within the casting molds, the core serves to form open areas in a cast shape (casting). In an embodiment of the invention, the core shape that forms the pivot hole portion of a railcar knuckle has been modified to produce an area of increased metal thickness surrounding the pivot hole section of the knuckle. This increased metal thickness serves to more evenly distribute stresses in the areas which connect the nose and tail sections of the knuckle to the pivot hole portion of the knuckle. The additional metal surrounding the pivot hole also serves to increase the rigidity of the knuckle structure surrounding the pivot hole.

Tail Slot Modifications

Another such design improvement relates to reducing knuckle failure near the tail area. In an embodiment of the invention, the core shape has been modified to lengthen an internal rib structure which extends from an upper to a lower segment of the tail section of the railcar knuckle. The resulting tail structure receives more support across the opening between the upper and lower surface portions of the tail and as a result, exhibits greater strength with a minimal addition of metal and associated weight. In another embodiment of the invention, the core shape has been made smaller in the tail area of the railcar knuckle. The result is a thickening of the upper and lower tail wall structure. As with the lengthened rib structure described above, the resultant tail structure has demonstrated a higher resistance to failure during testing.

Throat Area Modifications

Yet another such design improvement is directed toward the reduction of knuckle failure near the throat area (i.e., the transition area between the nose section and the section of the knuckle containing the pivot pin hole). Known designs have incorporated three "finger" shaped open areas in the nose structure, connecting the core between the flag hole located in the nose section and the pivot hole section of the railcar knuckle casting. In an embodiment of the current invention, the "finger" shapes have been reduced to two with an increase in the size of the finger from prior designs. In addition, an open area located between the nose and pivot pin area found in known designs has been removed. This design change serves to increase the amount of metal structure located in key areas of the nose and throat section of the railcar knuckle. This additional material functions to more evenly distribute stress and increase stability in the throat area of the railcar knuckle casting.

Improving Surface Finish

Another aspect of the invention is directed to improvements in railcar knuckle manufacturing processes. Such improvements comprise modifying certain surfaces of railcar knuckles during the manufacturing process using washes applied to casting molds, orientation of the abrasive during critical surface grinding operations, and shot-peening of at least one of these surfaces. The quality of the surface finish of a casting may affect the strength of a cast component such as a railcar knuckle, particularly in areas of high stress. Generally, a smooth and uniform surface will be more resistant to stress related failures than a surface which is rough or irregular. Because of this, methods are described that may be employed to improve the surface of railcar knuckle castings in embodiments of the invention.

Zircon Wash

Coating materials may be applied to casting molds to improve the surfaces formed during the casting process. Similarly, coatings may be applied to cores inserted into such molds. These coatings may be applied in a number of ways including, but not limited to, spraying and core washes. Coatings may comprise compounds formed from ceramics, Zircon, Chromite, graphitic, and other materials. While such coatings may be applied to entire mold and core surfaces, coatings may also be applied only to those areas which produce casting surfaces for which surface quality is of a greater concern.

Directional Surface Grinding

Surface grinding is a method of removing imperfections from the surface of a casting that result from corresponding imperfections in the mold surfaces and parting lines that may result from joints between mold sections. The process of surface grinding may be performed using hand or machine held grinding tools. One embodiment of such a tool is a motor which drives a circular abrasive wheel. During surface grinding, the circular abrasive wheel may be caused to rotate on an axel. While rotating, the wheel may be applied to that portion of the casting which requires removal of imperfections. As will be described in more detail herein, in an embodiment of the invention, grinding with the abrasive wheel aligned in the direction of stress applied to a casting may result in a more durable knuckle casting that if the grinding were performed with the grinding wheel aligned transverse to the direction of applied stress.

Shot Peening

Another aspect of the invention is directed to an improvement in railcar knuckle manufacturing processes resulting from shot peening. Particularly, it has been discovered that shot peening certain areas of a railcar knuckle improves the fatigue life of the knuckle.

This is understood to occur by way of increasing the residual compressive surface stresses of the knuckle material through the plastic deformation thereof. The shot peening media used in the invention may vary. For example, metallic, ceramic, or glass media may be used as long as it can produce an acceptable amount of plastic deformation of the knuckle surface.

Testing and analysis has also revealed that the surface finish in the highly stressed areas of a railcar knuckle is a factor in fatigue life. Particularly, a better surface finish increases fatigue life. Consequently, in addition to mold improvements and directional grinding, consideration should also be given to the resulting surface finish when shot peening a railcar knuckle. To this end, the size of the shot peening media and the intensity at which it is applied may be controlled in a manner intended to produce a more ideal surface finish. For example, it would be understood that larger media would likely produce an increased level of residual compressive surface stress, but might also produce an unacceptable surface finish.

In light of the foregoing concerns, certain embodiments of the invention may also employ a multi-step, sequential shot peening process. For example, shot peening with media of one type and/or size may be followed by shot peening with media of another type and/or size.

Metal Formulations

Railcar knuckles may be formed from various metal formulations. The described design and manufacturing process improvements are independent of metal formulation and therefore may equally be applied to various metal formulations used to cast railcar knuckles.

These design and manufacturing improvements have demonstrated improved performance when compared to known knuckle designs during AAR M-216 fatigue testing and therefore may result in more durable and cost effective railcar knuckles.

Shot Peening Process

The invention is also directed to automated or semi-automated systems and methods of shot peening railcar knuckles in the desired areas.

Embodiments of such systems and methods may employ a conveying system(s) or other automated means for transporting knuckles along a processing path. As a knuckle travels along the processing path, the areas of interest on the knuckle are shot-peened by shot-peening devices that include shot-peening mechanisms such as centrifugal blast wheels or air blast devices. For example, one or a plurality of multi-axis robots may be located along the travel path and equipped with shot-emitting mechanisms for this purpose, or a number of stationary shot-emitting devices may be employed instead of or in conjunction with shot-peening robots. Alternatively, an operator may manually operate a shot-peening mechanism to effect shot peening of the desired knuckle areas.

Conveying systems for use in a shot peening operation according to the invention may take several forms. For example, a conveying system useable in the invention may comprise a conveyor belt of some type that transports a knuckle to be processed to a shot-peening area where it is picked up by a robot and presented to one or more shot-emitting mechanisms such that the knuckle areas of interest are shot-peened.

In another conveying system embodiment, a knuckle(s) may be placed on a specialized conveyor that includes individual knuckle supporting carriers. The carriers may include knuckle retaining elements that are designed to rotate, such as by motor power or by contact with trip dogs, such that various areas of interest on the knuckle are presented to one or more shot-emitting mechanisms for shot-peening as the knuckle travels along the processing path.

In still another embodiment, a knuckle(s) may be placed on a specialized conveyor that may include knuckle supporting jigs or similar support elements that are designed to support and retain a knuckle through only limited points of contact, thereby leaving the areas of interest on the knuckle exposed for shot peening and eliminating the need for knuckle rotation. In such an embodiment, the conveyor may also be specially designed to permit access to various knuckle surfaces by a shot-peening device. For example, the conveyor may be two parallel but spaced apart belts such that one or more shot peening devices may be positioned along the conveyor path and in the space between the belts for shot-peening one or more lower knuckle surfaces from below. In such embodiments, the areas of interest on the knuckle may be shot-peened by stationary shot-emitting mechanisms, and/or by one or more robots equipped with shot-emitting mechanisms, as the knuckle travels along the processing path.

In systems of the invention, shot peening may occur while a knuckle is in motion—either rotationally or during travel along the processing path on an associated conveying device. Alternatively, shot peening may occur while the motion of a knuckle is temporarily halted, such as at one or more predetermined shot-peening stations.

In addition to the novel features and advantages mentioned above, other benefits will be readily apparent from the following descriptions of the drawings and exemplary embodiments

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

The detailed description that follows makes reference to railcar knuckles for ease of description. In addition to railcar knuckles, the embodiments described may be applied to other transit coupling devices, particularly those used in mass transit applications. One of ordinary skill in the art will understand that the stresses encountered in railcar applications are often greater than other applications due to the high weight levels often encountered when transporting freight using railcars. However, other transit applications may be equally demanding, particularly when passenger safety becomes an issue as may be the case in mass-transit applications.

One ordinarily skilled in the art will understand that the design and process improvements disclosed herein are equally applicable to the numerous and well known metal formulations used in the fabrication of railcar knuckles and other coupling devices.

Figure 1C:
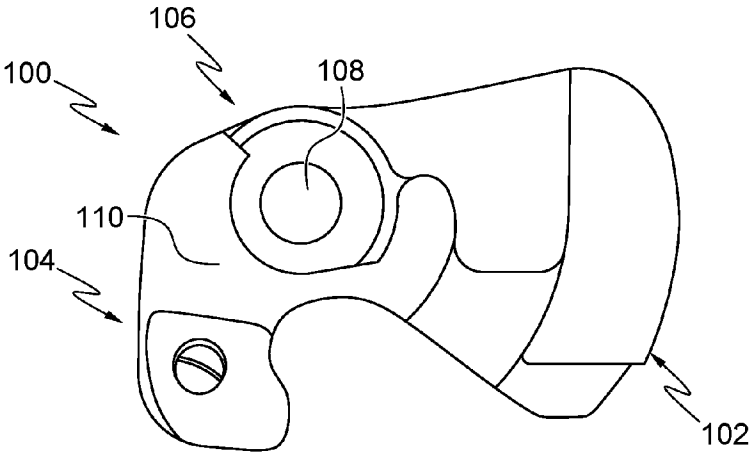
FIGS. 1*a*-1*c* are perspective, side, and top views, respectively, of an exemplary railcar knuckle manufactured according to the invention.
Figure 1B:
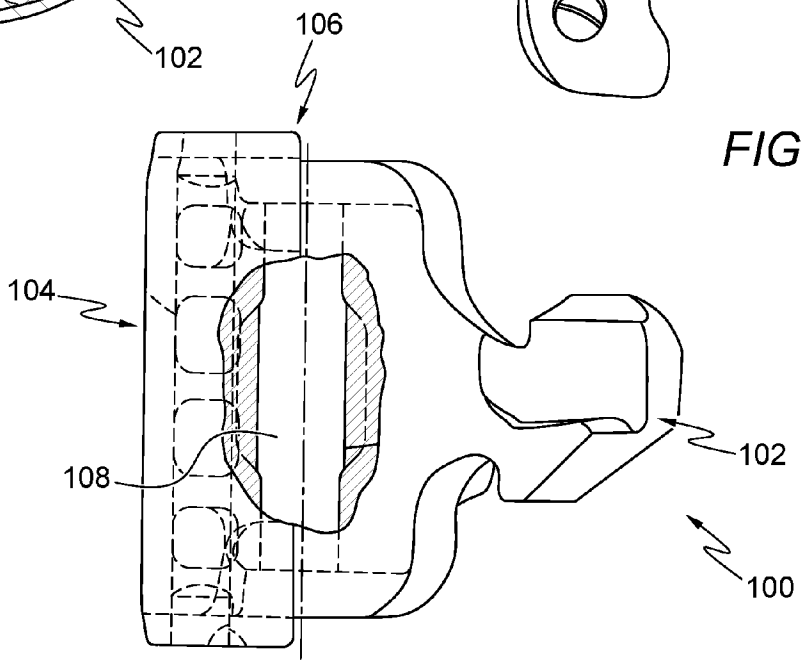
Figure 1A:
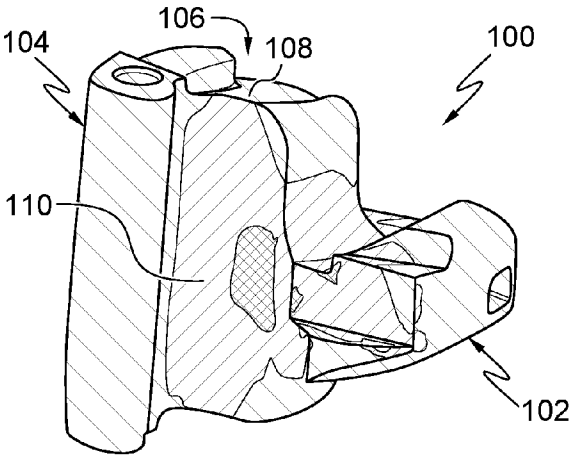

One exemplary embodiment of a typical known railcar knuckle 100 is illustrated in FIGS. 1*a*-1*c*. As shown, the knuckle 100 includes a tail section 102, a nose section 104, and a hub section 106 that includes a pivot pin hole 108. A throat section 110 of the knuckle 100 is located in a transition area between the nose section 104 and the hub section 106.

Figure 2:
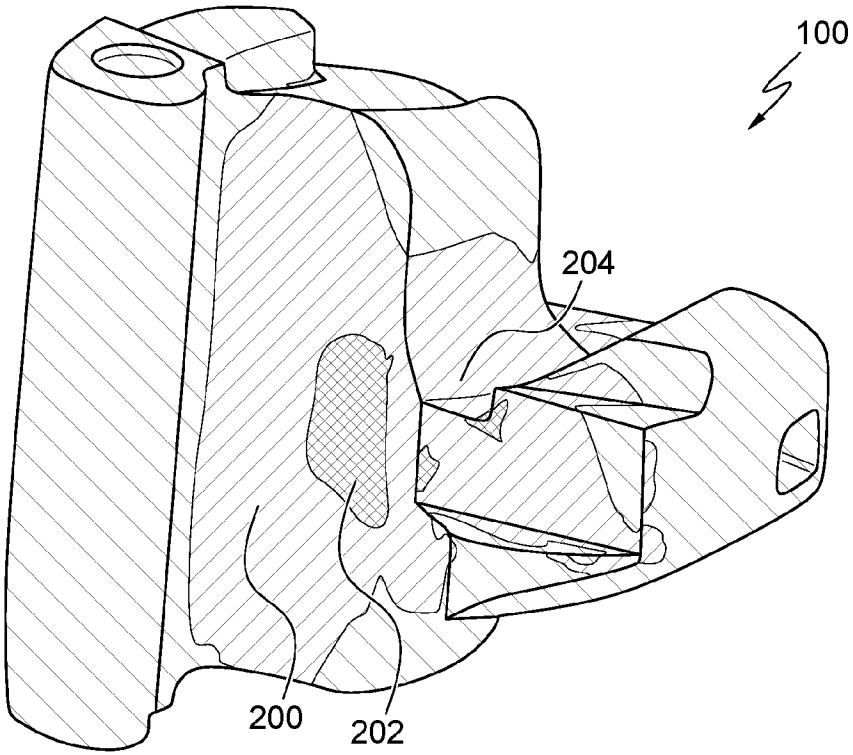
FIG. 2 is a finite element analysis (FEA) rendering of the stresses produced in a railcar knuckle of known design.

FIG. 2 is a finite element analysis (FEA) rendering of the stresses produced in the known railcar knuckle shown in FIGS. 1*a*-1*c* when loaded. As can be seen, the pivot pin hole area 202, throat area 200 and tail area 204 are all areas of high stress. While the FEA rendering of FIG. 2 is specific to the railcar knuckle 100 of FIGS. 1*a*-1*c*, it should be understood that in general, railcar knuckles are subjected to high stresses in these areas.

To reduce the high stresses in the identified areas of a railcar knuckle, the present invention includes several modifications to known railcar knuckle designs. One, two or all of these improvements may be applied in the manufacturing process used to produce an improved railcar knuckle.

Pivot Hole Modifications

Figure 4:
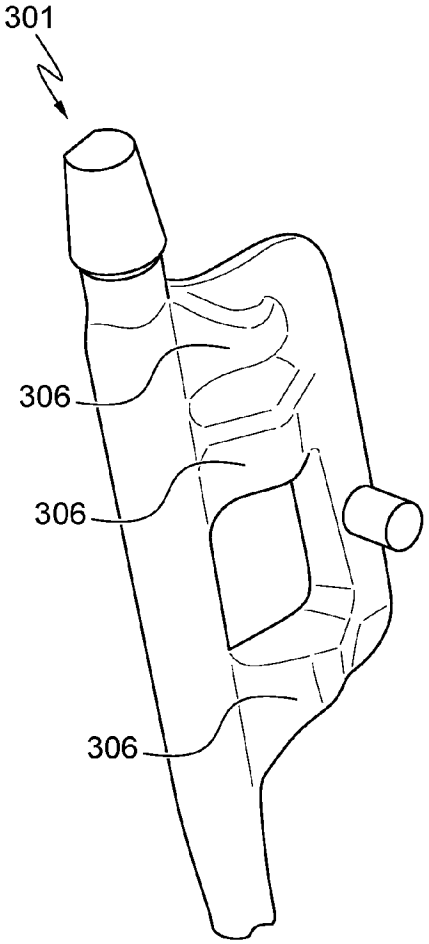
FIG. 4 is a 3-D computer rendering of a knuckle nose section casting core of known design.
Figure 3:
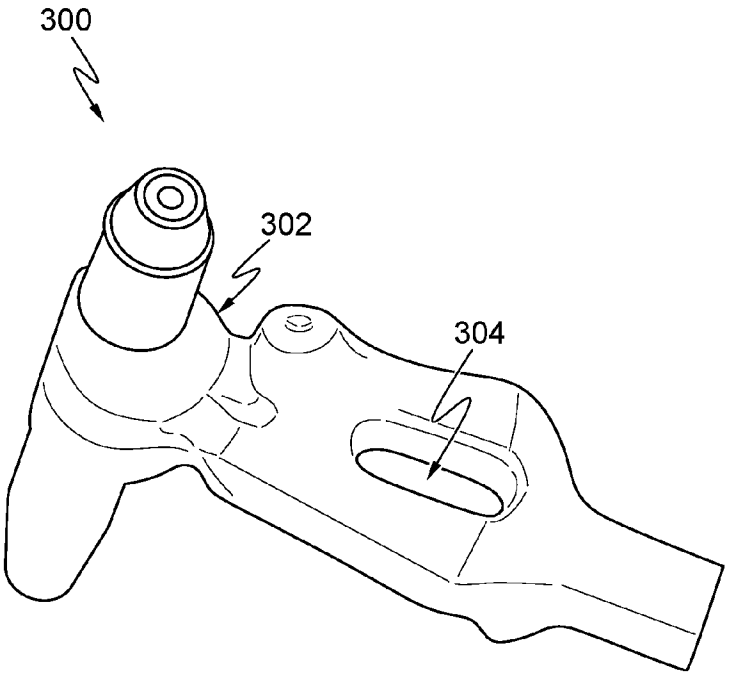
FIG. 3 is a 3-D computer renderings of a knuckle body section casting core of known design.
Figure 6:
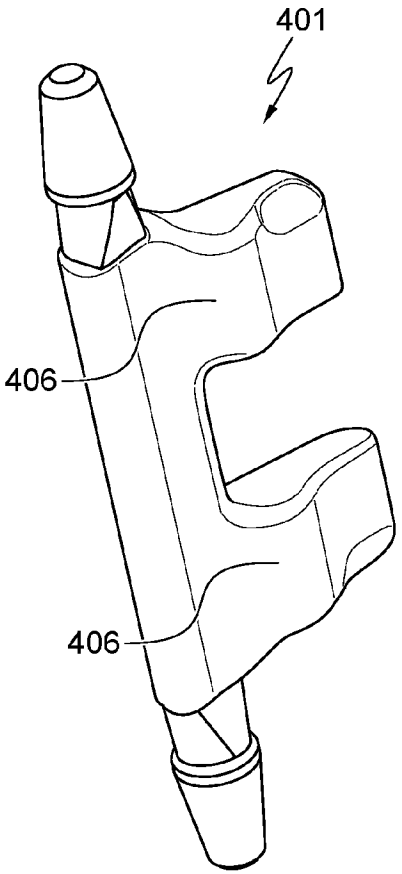
FIG. 6 is a 3-D computer rendering of a knuckle nose section_casting core, illustrating an embodiment of the current invention.
Figure 5:
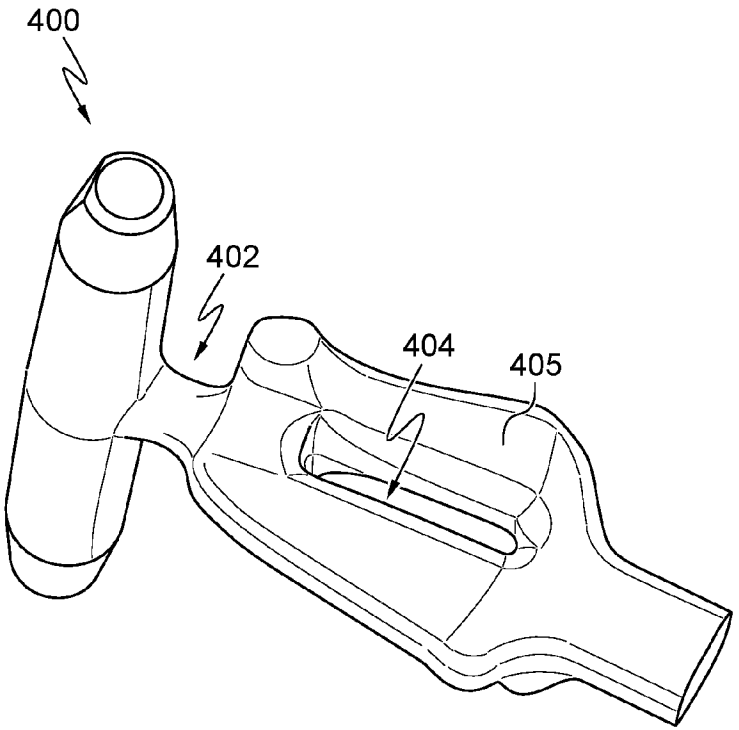
FIG. 5 is a 3-D computer renderings of a knuckle body section_casting core, illustrating an embodiment of the current invention.
Figure 9:
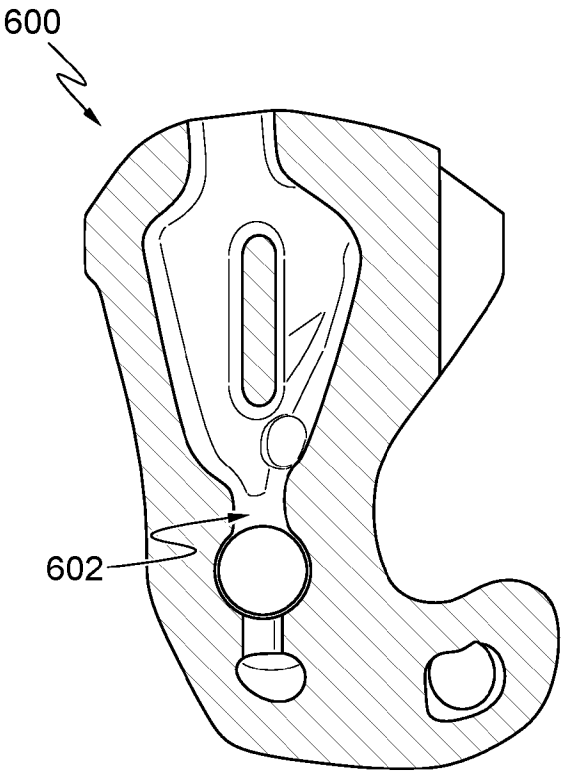
FIG. 9 is a cross section view illustrating modifications to the railcar knuckle of FIGS. 1*a*-1*c;*

One area that has exhibited failures in known railcar knuckle designs is the area of the pivot hole. In an embodiment of the invention, the core used to form open areas in a railcar knuckle has been modified in the area of the pivot hole. FIGS. 3 and 4 illustrate computer models of two elements of a known core design 300 and 301. At 302, a relief area is shown near the portion of the core which forms the pivot hole. Referring to FIGS. 5 and 6, which illustrate computer models of two elements of a core 400 and 401 modified according an embodiment of the invention, an area of reduced relief is shown at 402. Such a modification results in additional metal surrounding the pivot hole in a completed railcar knuckle. Referring FIG. 7, which illustrates a cross sectional view of a pre-inventive embodiment of the pivot hole area of a railcar knuckle 500, an open area 502 is visible in the vicinity of the pivot hole. A similar cross section of the modified knuckle is illustrated in FIG. 9. As shown in FIG. 9, the improved railcar knuckle 600 is modified in the pivot pin hole area 602 as a result of the reduced relief 402 in the casting core, resulting in additional metal in the area.

Figure 10:
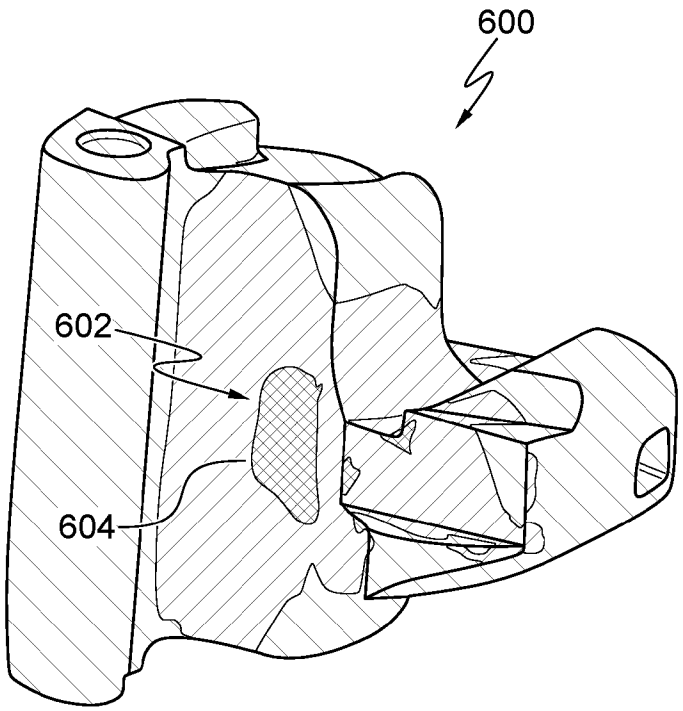
FIG. 10 is a FEA rendering illustrating a reduction of the stress load in the area of a knuckle pivot pin hole.

The effect of the modification to the knuckle 600 shown in FIG. 9 is illustrated in the finite element analysis (FEA) rendering of FIG. 10. As can be observed, the modification of FIG. 9 at least has the effect of reducing the stress load 604 in the pivot pin hole area 602 of the knuckle 600.

Tail Section Modification

Figure 7:
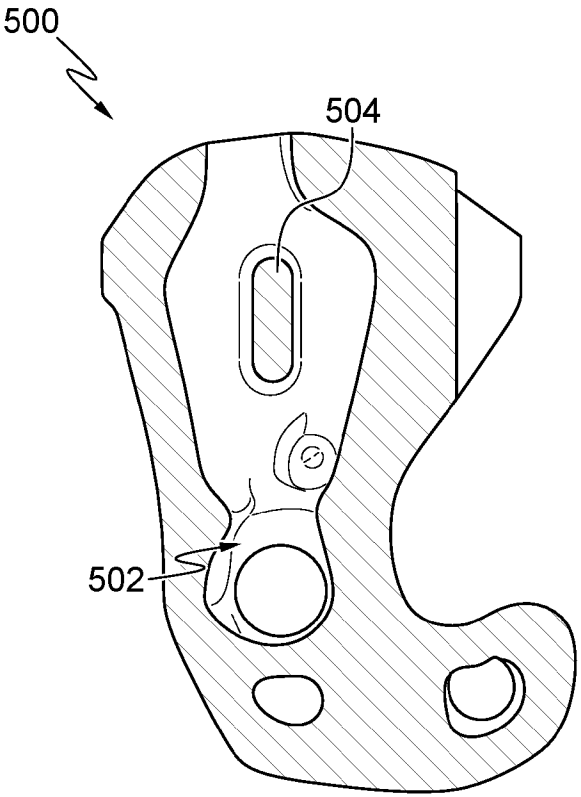
FIG. 7 represent a cross section view of a railcar knuckle of known design.
Figure 11:
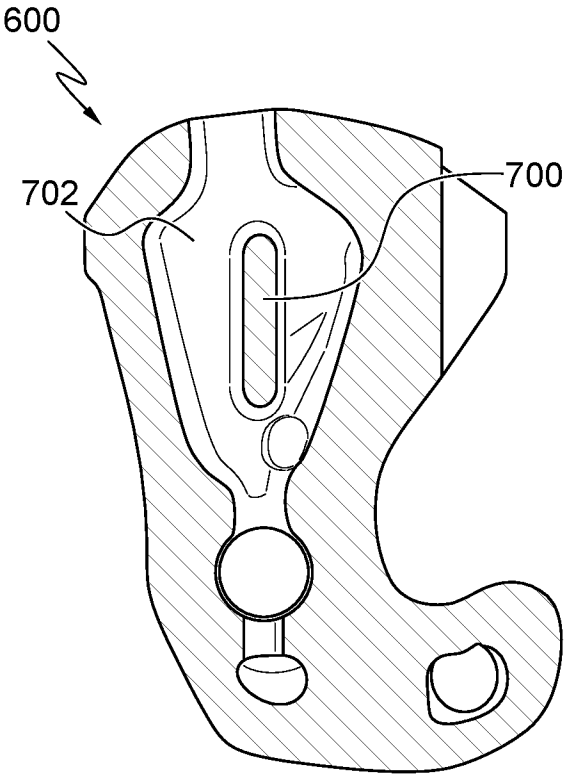
FIG. 11 is a representation of modifications to the railcar knuckle of FIGS. 1*a*-1*c;*

In another embodiment of the invention, the core design is modified to produce a longer opening in the tail section of the casting core (tail slot), resulting in a longer "rib" between the upper and lower surfaces of the tail portion 102 of a railcar knuckle. In addition, the core used in the tail section may be reduced in thickness, resulting in a thickening of the upper and lower portions of the tail section of the knuckle. FIGS. 3 and 4 show computer models of two elements of a pre-inventive embodiment of a railcar knuckle casting core. A slot 304 is visible in the tail section of the core. Referring to FIGS. 5 and 6, which illustrate computer models of two elements of a core modified according to an embodiment of the invention, a longer slot 404 and a thinner tail section 405 is shown. FIG. 7 is a cross section view of a rail car knuckle without the tail section modification. An unmodified rib section is illustrated at 504. FIG. 11 is a cutaway view illustrating the modified rib 700 and thicker wall thickness which result from the modified core design.

Figure 12:
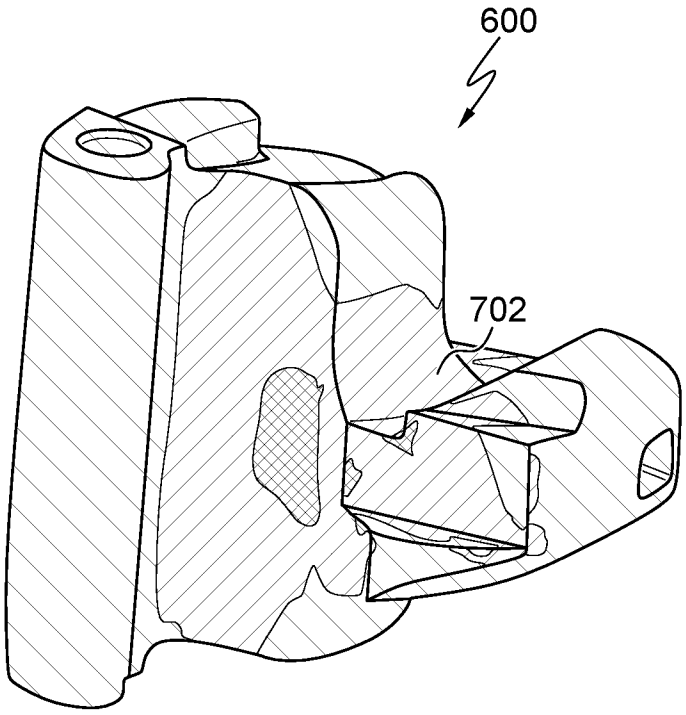
FIG. 12 is a FEA rendering illustrating a reduction of the stress load in the area of a knuckle tail section.

The effect of the modification shown in FIG. 11 is illustrated in the FEA rendering of FIG. 12. As can be observed, the modification of FIG. 11 has the effect of reducing the stress load in the tail area 702 of the knuckle 600.

Throat Area Modifications

In another embodiment of the invention, the throat area 110 of the railcar knuckle has been modified to change the number and position of internal open spaces present in that area. Referring to FIG. 4, which illustrates a pre-invention embodiment of a railcar knuckle casting core design 301. Visible at 306 are three "fingers" connecting to the flag core section of the core. In FIG. 6, which illustrates a core modified according to an embodiment of the present invention 401, the change to a two finger design is shown at 406.

Figure 8:
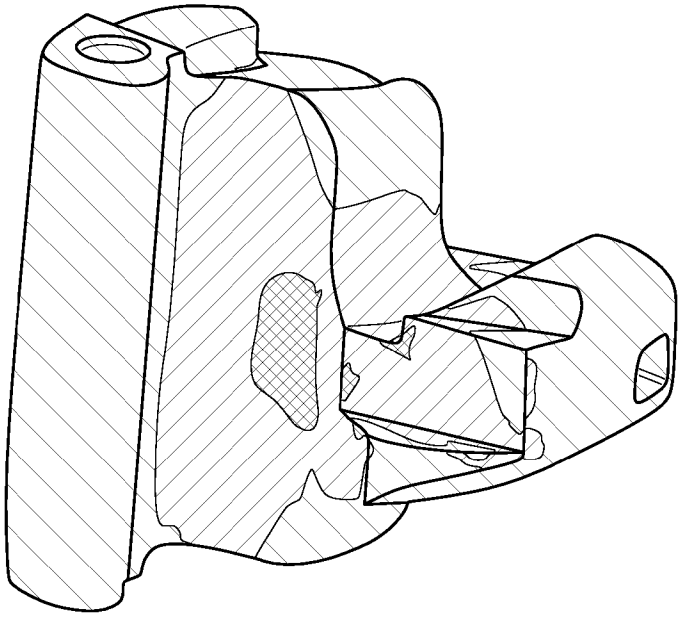
FIG. 8 is a FEA rendering illustrating stress loads in a railcar knuckle of known design.
Figure 14:
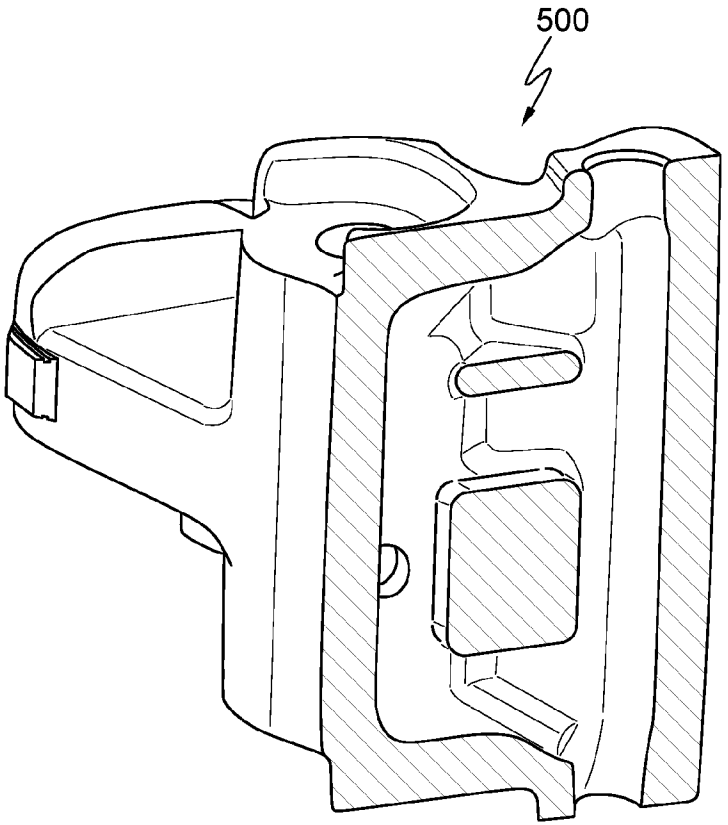
FIG. 14 is a cross section of a portion of a railcar knuckle manufactured using the finger core of FIG. 13.
Figure 13:
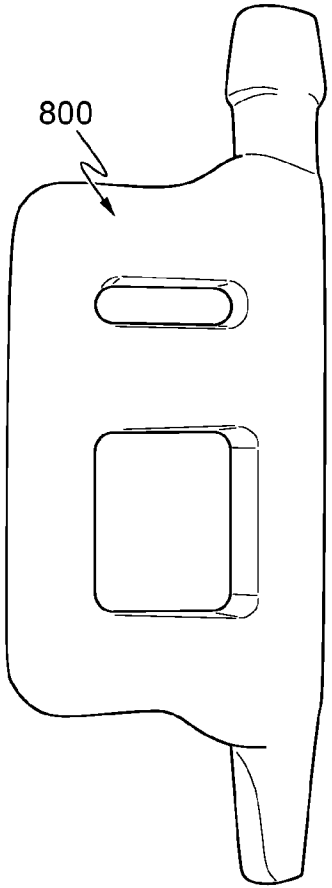
FIG. 13 depicts a finger core of a known design, used in a railcar knuckle casting mold.
Figure 16:
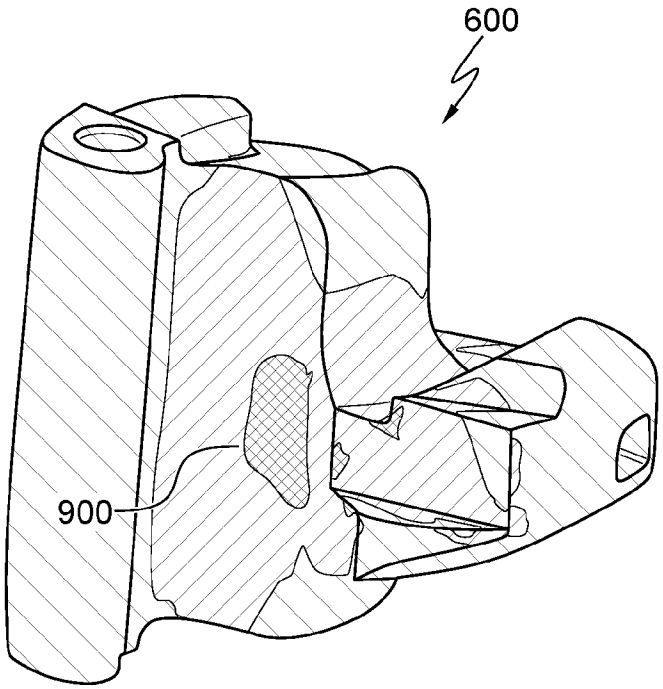
FIG. 16 is a FEA rendering illustrating a reduction of the stress load in the throat area of the railcar knuckle of FIG. 15.
Figure 15:
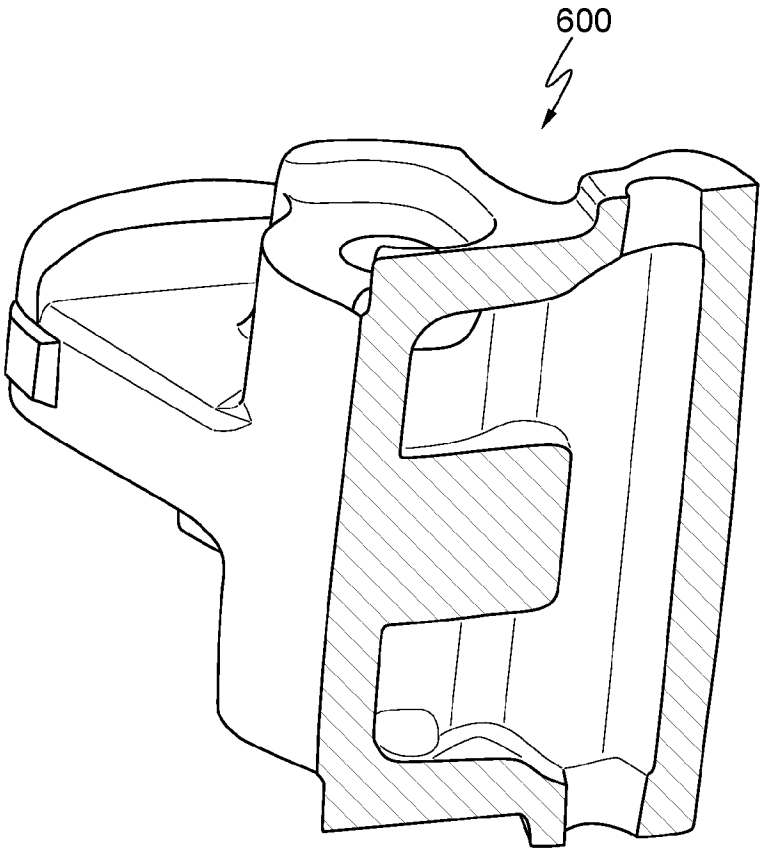
FIG. 15 is a computer model representing a cross section of a portion of a railcar knuckle manufactured using an embodiment of the inventive design core.

FIG. 13 illustrates a pre-inventive embodiment of a railcar knuckle casting mold finger core 800. FIG. 14 is a cross section of a portion of a railcar knuckle 500 manufactured using the three finger core of FIG. 4. FIG. 15 shows a cross section of a portion of a railcar knuckle 600 manufactured using the two fingered core of FIG. 6. As a result of the decrease number of "fingers" in the core, the amount of metal in the flag core section of the knuckle is increased. The effect of the modifications shown in FIG. 15 is illustrated in the FEA rendering of FIG. 16. As can be observed, the knuckle modification depicted in FIG. 15, which results from the finger core modification shown in FIG. 6, has the effect of reducing the stress load in the throat area 900 of the knuckle 600 when compared to the stress load of known designs as illustrated in FIG. 8.

Other aspects of the invention are directed to improvements in railcar knuckle manufacturing processes to improve certain areas of the railcar knuckle.

The Casting Process

Railcar knuckles may be produced using a casting operation in which the molds may be formed using a sand material that has been treated to retain its shape during the casting operation. Generally a mold is comprised of at least two sections. A core, such as the exemplary core illustrated in FIGS. 5 and 6 as 400 and 401, is placed in one of the mold sections and the sections are caused to be held in proximity to one another, creating a hollow chamber, partially occupied by the core within the sections. The core 400 and 401 serves to form open sections within the resulting cast shape formed by the casting process. Molten metal may then be introduced into an opening in at least one of the mold sections, filling the hollow chamber within to form the desired shape. When the metal has sufficiently cooled, the mold sections are disassembled and the core is broken apart for removal from the casting.

When molten metal is introduced into the mold sections, the extreme heat of the metal may cause moisture contained in the casting sand to rapidly vaporize into steam. Such rapid vaporization may disturb the casting sand, resulting in imperfections in the surface of the shape formed as a result of the casting operation. Additional surface imperfections are often located at the parting lines formed at points where sections of the mold are held in contact with each other during the casting process.

Figure 17:
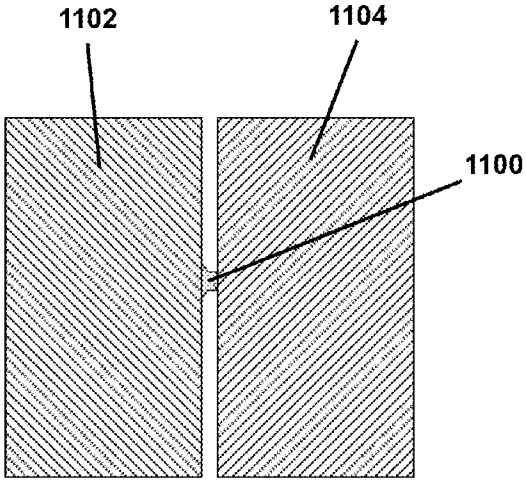
FIG. 17 is an illustration of a surface imperfection on a first casting in contact with a second casting.

Imperfections on the surface of the casting may result in stress points which may result in areas of weakness. Because of this, producing a shape with a minimal number of imperfections may result in a more durable casting. Additionally, when the casting is intended to make contact with another shape under high levels of pressure, the areas of contact should be as free from imperfections as possible to avoid uneven pressures along the area of contact. In FIG. 17, an imperfection 1100 on a first surface 1102 comes in contact with a second surface 1104. When forces are applied to cause the surfaces to exert pressure upon each other, such pressure may be applied unevenly as a result of the imperfection 1100. This uneven pressure may result in high stress levels in the area of a casting near the imperfection, which in turn, may result in premature failure of the casting. To avoid these premature failures, such imperfections should be avoided or removed.

Zircon Wash

As was described above, casting molds are commonly formed from sand materials. During the casting process, this sand forms the outer surface of the casting. Because the mold surface is formed from grains of sand, the surface of the resulting casting may be rough and uneven. When casting railcar knuckles, this roughness and other imperfections that may form in a casting may be mitigated through the use of additives and coatings applied to those areas of the casting molds that form knuckle surface areas. In an embodiment of the invention, a zircon core wash may be sprayed onto the mold surfaces to obtain a surface with fewer imperfections than generally may be obtained with untreated mold surfaces. Zircon washes are available from multiple suppliers, including ASK Chemicals. (ASK Chemicals offers zircon washes under the following product names: VELVACOAT ZA 9078, VELVACOAT ZAC B 850, VELVALITE ZA 3, and VELVALITE ZA 848.)

Directional Grinding

Figure 19:
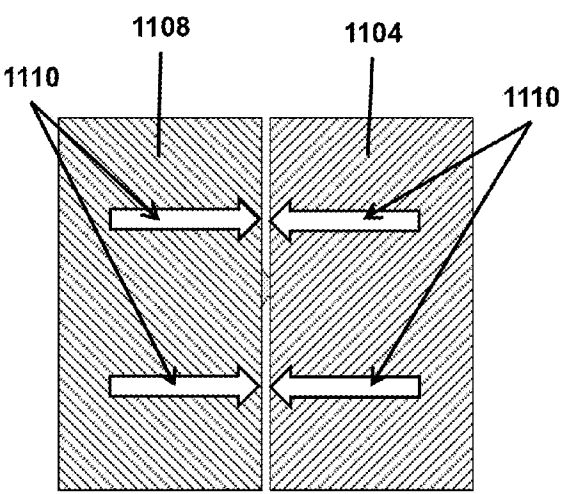
FIG. 19 is an illustration of a first casting, from which an imperfection has been ground away, in contact with a second casting.
Figure 18:
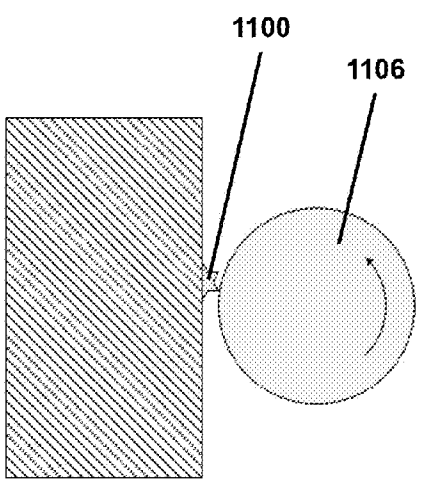
FIG. 18 is an illustration of a grinding operation to remove a surface imperfection from a casting.

Imperfections in a casting may be removed by a grinding process. As illustrated in FIG. 18, an imperfection 1100 may be removed by a grinder 1106. In FIG. 19, the first surface from which an imperfection has been removed 1108, is caused to be in contact with a second surface 1104. As is illustrated by arrows 1110, when forces are applied to cause the surfaces to exert pressure on each other, the pressure may be applied more uniformly across each surface after an imperfection is removed. The result may be a more regular application of pressure and fewer points of stress along the surface areas in contact. A more regular application of pressures may result in fewer premature failures caused by uneven stress levels applied to a casting.

Figure 20:
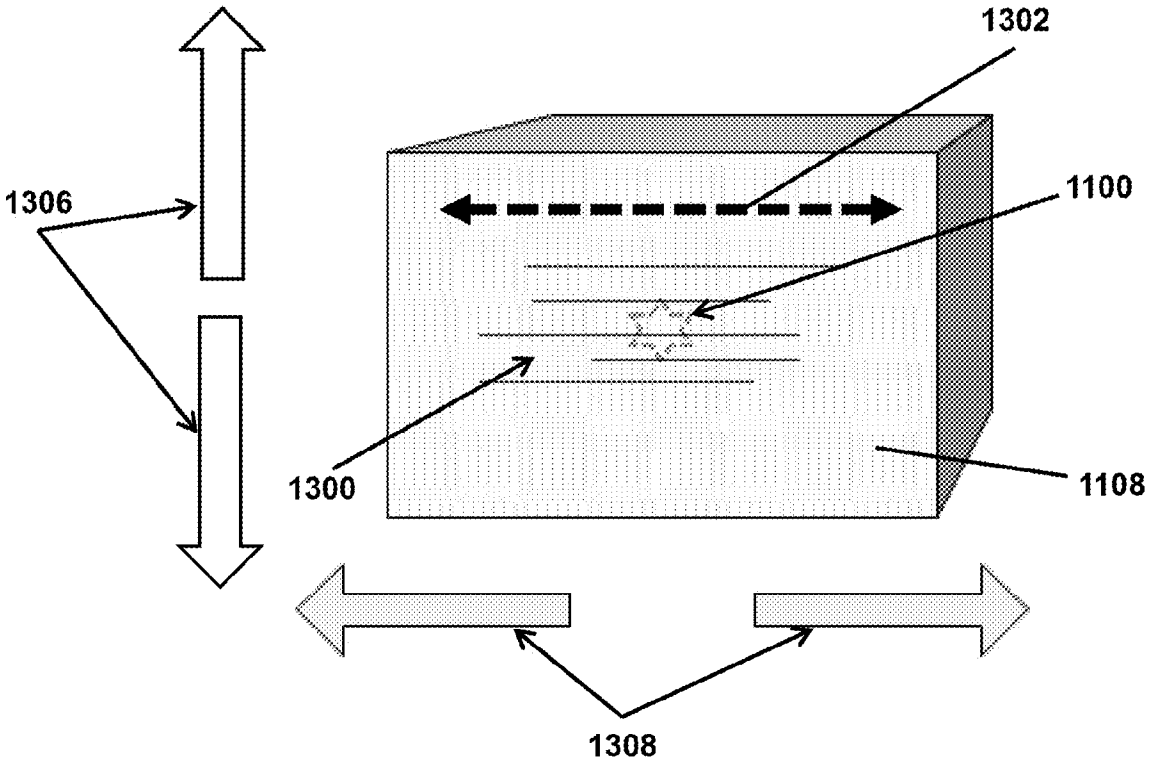
FIG. 20 is an illustration of surface striation patterns resulting from grinding imperfections from the surface of a casting.

A grinding operation, while it may reduce casting imperfections, may introduce a different type of imperfection which may weaken the casting. Grinders frequently employ circular abrasive wheels 1106. Such a grinder may employ a power source to rotate the abrasive wheel which is applied to an imperfection 1100 to be ground. Referring to FIG. 20, when an abrasive wheel 1106 makes contact with a surface 1108, the abrasive wheel removes material by creating scratches (striations) 1300 in the surface that correspond to the abrasive particles found in the abrasive wheel. As is illustrated at 1300, these striations are formed along an imagined line 1302 corresponding to the plane of the grinding wheel as the plane intersects the surface being ground. These striations 1300 result in a form of surface imperfection that may result in weaknesses in a casting to forces that are applied in a direction that is transverse to the direction of the previously described striations. Such a transverse force is illustrated in FIG. 20 as 1306. The striations 1300 may act as the start of "tears" in a casting that result in a failure. In an embodiment of the invention, grinding that produces striations that are transverse to the direction of stress in a casting is avoided. As is illustrated in FIG. 20, grinding is performed such that the striations 1300 formed by the grinding are aligned with the direction of forces 1308 applied to a casting.

Figure 21:
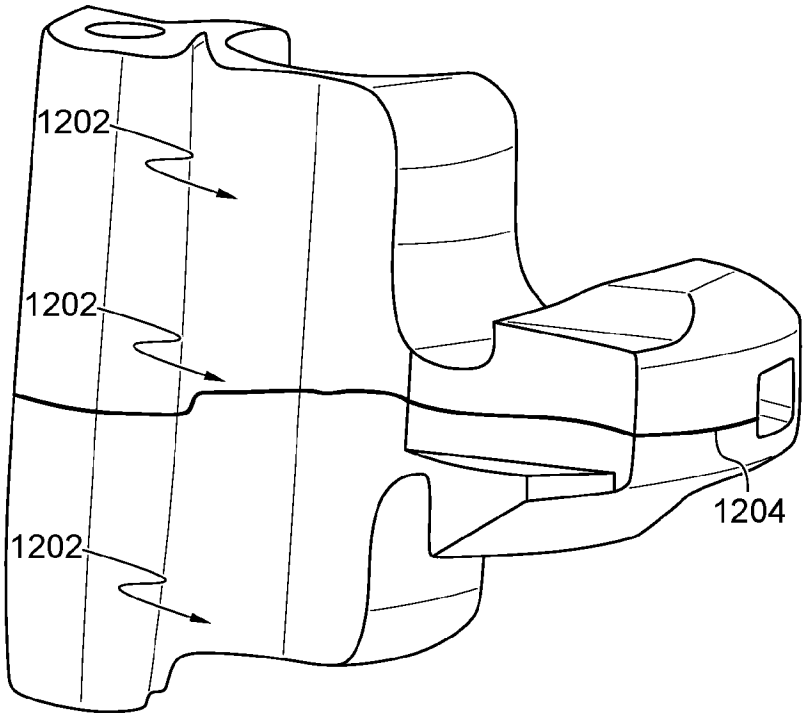
FIG. 21 is a computer model of a railcar knuckle illustrating areas in which imperfections are ground away.

A slope or draft angle may be formed in a mold to allow removal of the form used to shape the sand portion of the mold. In order to allow for such a draft angle, mold sections used to form railcar knuckles are generally formed such that each section forms one-half of the resulting knuckle. A parting line is an imperfection in a casting surface that may result where sections of a mold meet. As is shown in FIG. 21, a parting line 1204 results from the use of a two piece mold in a typical railcar knuckle casting. Because of the draft angle required when creating railcar knuckle molds, the parting line traverses the throat area of railcar knuckles. As was illustrated in FIG. 17, imperfections in contact areas of a casting may result in uneven stress distributions and resulting premature failures.

During operation, the railcar knuckle throat area is in contact with a second railcar knuckle and exposed to pulling stresses that are parallel to the parting line. In an embodiment of the invention, grinding imperfections in the throat areas 1202, including imperfections that are the result of the parting line 1204 illustrated in FIG. 21, is performed such that the resulting striation pattern is substantially parallel to the direction of stress. Such directional grinding has been found to improve the ability of embodiments of the improved railcar knuckle to withstand fatigue testing required by the AAR M-216 standard.

Shot Peening

Figure 22:
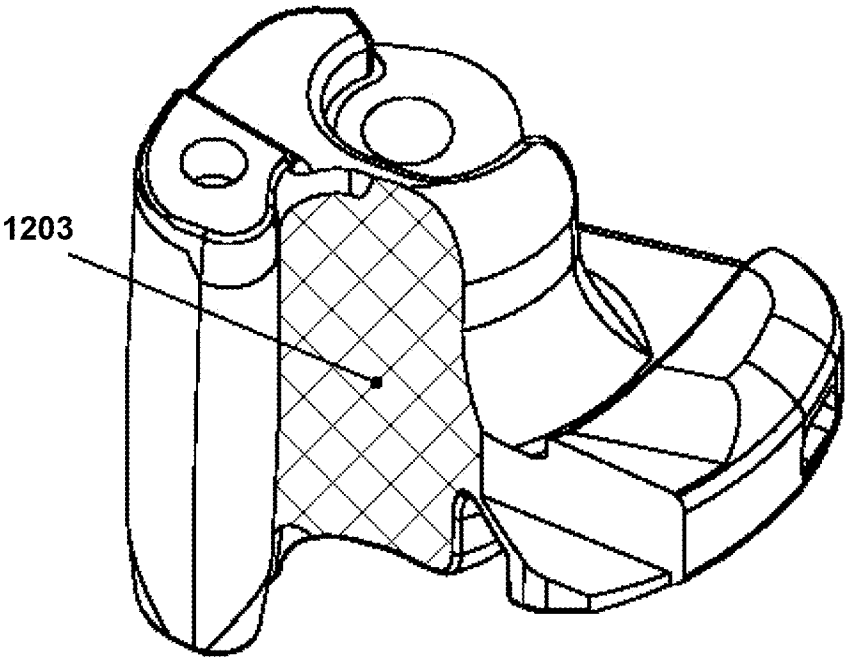
FIG. 22 is a computer model of a railcar knuckle illustrating areas in which a shot peening process is applied.

A shot peening process may increase the residual compressive surface stresses of a cast material through a process of plastic deformation. Testing and failure analysis has shown residual compressive surface stress may improve the durability of a railcar casting in areas that are subject to high levels of stress. Additionally, analysis has shown that surface quality after a shot peening process is an additional factor in the durability of a railcar knuckle. Referring to FIG. 22, in an embodiment of the invention, a shot peening process is applied to the throat area 1203 of a railcar knuckle. In order to produce a higher quality surface area, the shot peening media used in the invention may be varied in size and intensity of application and may comprise metallic, ceramic, or glass media. The effects of such variables are dependent upon the casting material and shot applicators and as a result, a shot peening process should be carefully controlled with regard to the shot applied and the rate of application in order to produce a uniform surface texture. A multi-step shot peening system that may be employed to produce such a uniform surface is described herein.

Figure 23A:
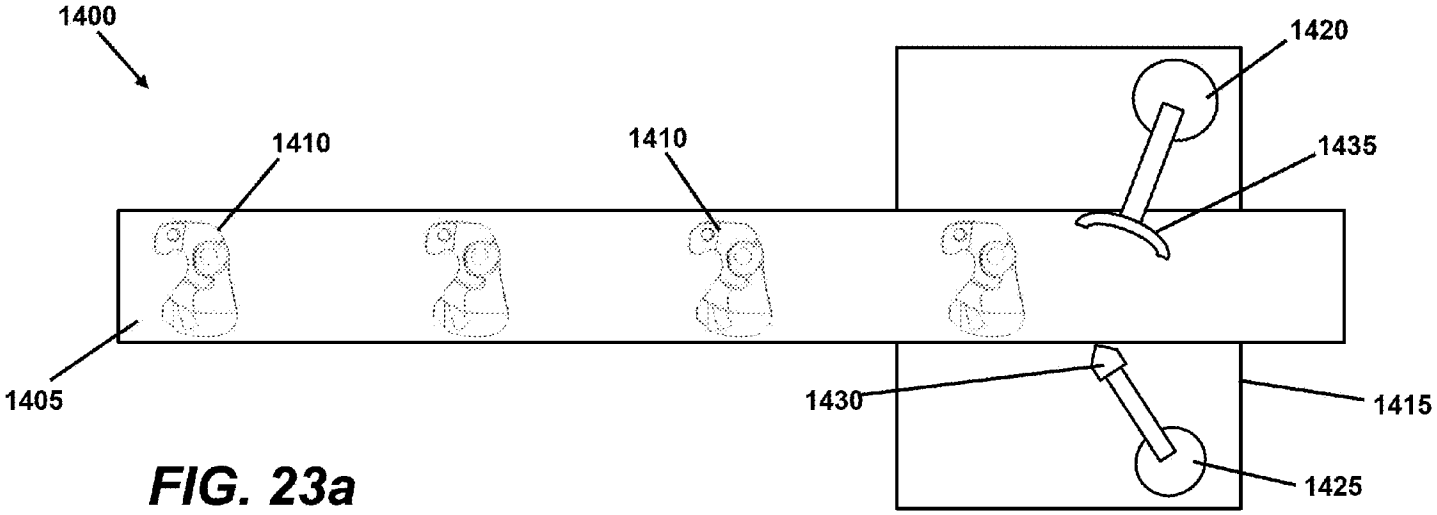
FIG. 23*a* schematically represents an exemplary embodiment of a railcar knuckle shot-peening system and process whereby a conveyor transports knuckles to a shot-peening area where each knuckle is picked up by a multi-axis robot and presented to another multi-axis robot that is equipped with a shot-emitting mechanism.

One exemplary embodiment of a railcar knuckle shot-peening system 1400 and process is schematically represented in FIG. 23*a*. In this exemplary embodiment, a conveyor 1405 transports knuckles 1410 to a shot-peening area 1415 where each knuckle is picked up by a part handling robot 1420 and is presented to another robot 1425 that is equipped with a shot-emitting mechanism 1430. Both the part-handling robot 1420 and shot-peening robot 1425 may be multi-axis robots for maximized process flexibility.

In this particular example, the conveyor 1405 is represented as a belt conveyor. It should be understood, however, that other types of conveyors may also be employed, such as without limitation, chain conveyors, roller conveyors, and conveyors which make use of individual carriers that travel in or along tracks or guides.

In the exemplary system 1400 of FIG. 23*a*, the part-handling robot 1420 is shown to be equipped with an end effector 1435 that is adapted for grasping and removing a knuckle 1410 from the conveyor 1405, and for releasably retaining the knuckle in multiple orientations during presentation thereof to the shot-peening robot 1425. End effectors for part handling are well known in the art and, therefore, are not described in detail herein.

The shot-emitting mechanism 1430 of the shot-peening robot 1425 may be of various designs. For example, the shot-emitting mechanism 1430 may be an air blast system where the shot media is introduced into an air stream and ejected from a nozzle against an object to be peened. Alternatively, shot media may be introduced to a spinning centrifugal blast wheel that rotates at high speed to sling the shot media against an object to be peened. Shot-emitting mechanisms of the invention are not limited to air blast or centrifugal blast wheels, however. Rather, any shot-peening device now known or developed in the future may be used in the present invention provided it is capable of producing an acceptable level of plastic deformation on the peened knuckle surface.

Figure 23B:
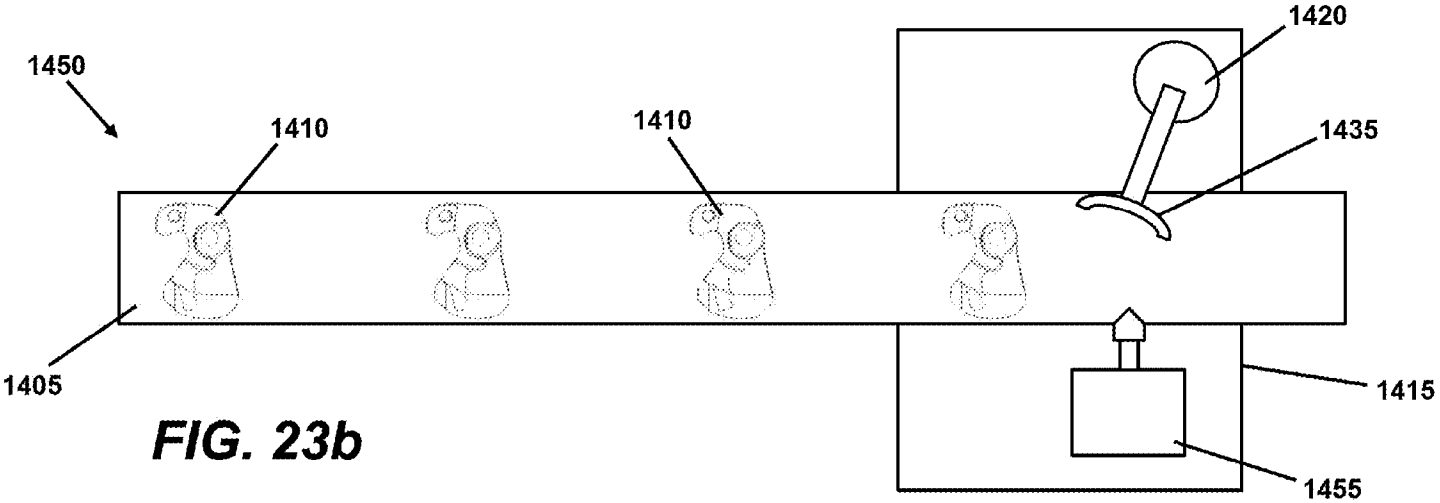
FIG. 23*b* schematically represents an exemplary embodiment of a railcar knuckle shot-peening system and process whereby a conveyor belt transports a knuckle to a shot-peening area where it is picked up by a multi-axis robot and presented to fixed position shot-emitting mechanism.

FIG. 23*b* schematically represents another exemplary embodiment of a railcar knuckle shot-peening system 1450 and process, which is very similar to the system 1400 and process represented in FIG. 23*a*. Particularly, this exemplary system 1450 again includes the conveyor 1405 and part-handling robot 1420 of the system 1400 of FIG. 23*a*, and the conveyor again transports knuckles 1410 to a shot-peening area 1415 where each knuckle is picked up by the part-handling robot 1420. In this system 1450, however, the part-handling robot 1420 presents knuckles 1410 to be peened to a fixed-position shot-emitting device 1455 rather than to a robot equipped with a shot-emitting mechanism.

In the system 1450 of FIG. 23*b*, the conveyor 1405 and part-handling robot 1420 may respectively be of any design/type/construction discussed above with respect to the system of FIG. 23*a*. Similarly, although the system of FIG. 23*b* employs a fixed-position shot-emitting device 1455, any of the various types of shot-emitting mechanisms described above with respect to the system 1400 of FIG. 23*a* may be used in the system 1450 of FIG. 23*b*.

Figure 24A:
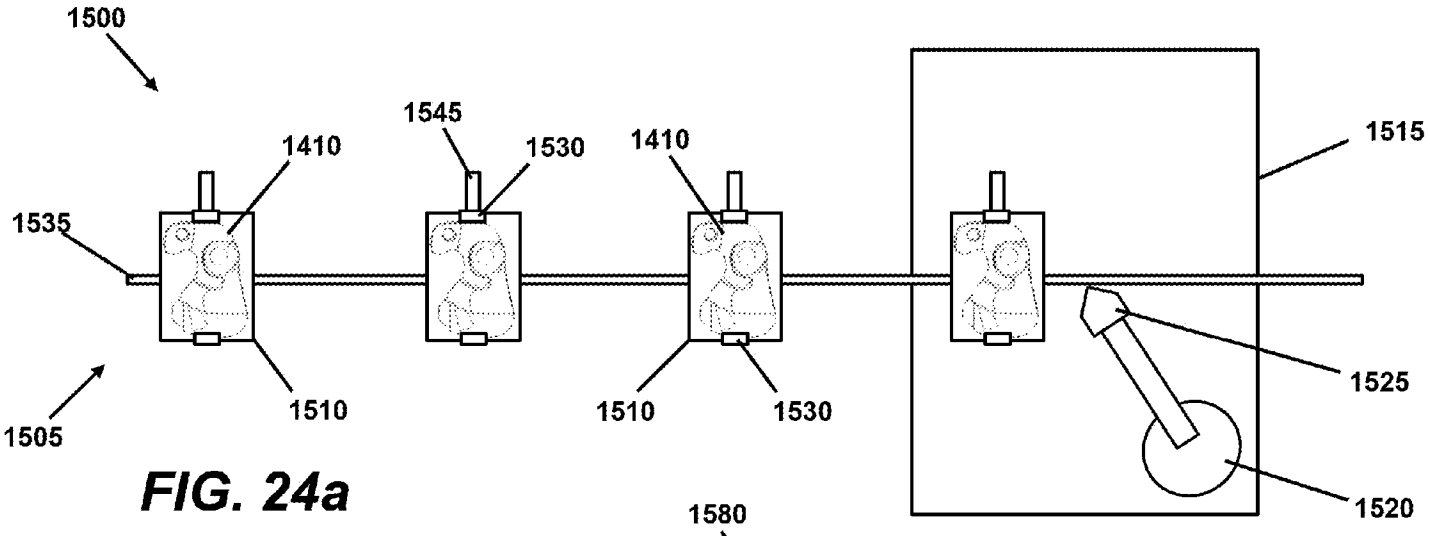
FIG. 24*a* schematically represents another exemplary embodiment of a railcar knuckle shot-peening system and process wherein knuckles are placed on a specialized conveyor that includes individual conveyor carriers that are designed to rotate the knuckle via a powered actuator such that the areas of interest on the knuckle are presented to one or more multi-axis robotic shot-emitting mechanisms for shot-peening.

FIG. 24*a* schematically represents another exemplary embodiment of a railcar knuckle shot-peening system 1500 and process. In this shot-peening system 1500, a conveyor 1505 having a plurality of individual carriers 1510 transports knuckles 1410 to a shot-peening area 1515. Each knuckle is peened while residing on an associated carrier 1510, by a shot-peening robot 1520 that is equipped with a shot-emitting mechanism 1525. The shot-peening robot 1520 may again be a multi-axis robot for maximized process flexibility. Any of the various types of shot-emitting mechanisms described above with respect to the system 1400 of FIG. 23*a* may be employed by the system 1500 of FIG. 24*a*.

In this particular example, the conveyor system 1405 includes individual carriers 1510 equipped with knuckle retaining elements 1530 (e.g., grippers, clamping assemblies, part nests, etc.). The carriers 1510 travel in or along a guideway such as a track 1535 that leads through the shot-peening area 1515. An actuator 1545 or actuator assembly capable of imparting rotational motion to a retained knuckle 1410 is associated with each carrier 1510 in this embodiment. For example, motors (e.g., servo motors) and cylinders may be used for this purpose. In any case, a knuckle 1410 is rotatably supported by the retaining elements 1530 of an associated carrier 1510 such that, when the carrier reaches a shot-peening location within the shot-peening area 1515, the knuckle may be rotated by the actuator 1545 while on the carrier so as to be presented in different orientations to the shot-peening robot 1520. In this manner, various areas of a given knuckle 1410 may be shot-peened without the need for a separate part-handling robot.

Figure 24B:
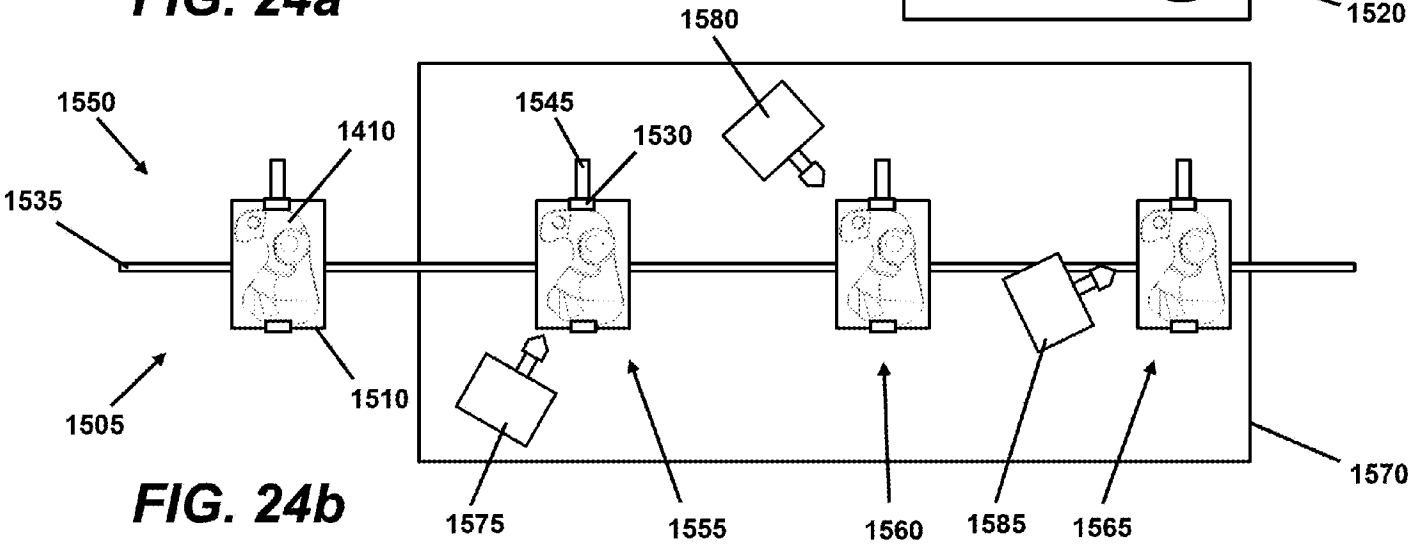
FIG. 24*b* schematically represents another exemplary embodiment of a railcar knuckle shot-peening system and process wherein knuckles are placed on a specialized conveyor that includes individual conveyor carriers that are designed to rotate the knuckle via a powered actuator such that the areas of interest on the knuckle are presented to one or more fixed position shot-emitting mechanisms for shot-peening.

FIG. 24*b* schematically represents another exemplary embodiment of a railcar knuckle shot-peening system 1550 and process, which uses the same carrier system 1405 or a similar carrier system to that used in the system 1500 and process represented in FIG. 24*a*. Particularly, this exemplary system 1550 also employs a conveyor system 1505 that includes individual carriers 1510 equipped with rotatable knuckle retaining elements 1530 and an actuator 1545 or actuator assembly capable of imparting rotational motion to a retained knuckle 1410 such that, when a given carrier reaches a predetermined shot-peening location 1555, 1560, 1565 within a shot-peening area 1570, the knuckle may be rotated by the actuator 1545 through different orientations while remaining on the carrier.

In the system 1550 of FIG. 24*b*, the knuckles are presented in a given orientation at each shot-peening location 1555, 1560, and 1565 to an associated fixed-position shot-peening device 1575, 1580, and 1585. Consequently, various areas of a given knuckle 1410 may be shot-peened. The fixed-position shot-peening devices 1575, 1580, 1585 may be equipped with any of the various types of shot-emitting mechanisms described above with respect to the system 1400 of FIG. 23*a*. While three individual fixed-position shot-peening devices 1575, 1580, and 1585 are shown in FIG. 24*b*, embodiments of the invention are not limited to any particular number of such devices.

It would be understood by one of skill in the art that there are other ways to cause the rotation of a knuckle 1410 while the knuckle is retained on a carrier 1510 of the system 1500 of FIG. 24*a* or the system 1550 of FIG. 24*b*. For example, and without limitation, in an alternative embodiment of the invention (not shown), each carrier 1510 may be equipped with one or more trip arms that contact a respective trip dog as the carrier reaches a given shot-peening location 1555, 1560, 1565. In such an embodiment, the motion of the carrier 1510 along the track 1535 is used to cause the rotation of the knuckle retaining elements 1530 and the knuckle 1410. Cams, stops, and/or various other techniques may be used to produce a desired degree of rotation of the knuckle at each given shot-peening location 1555, 1560, 1565.

Figure 25:
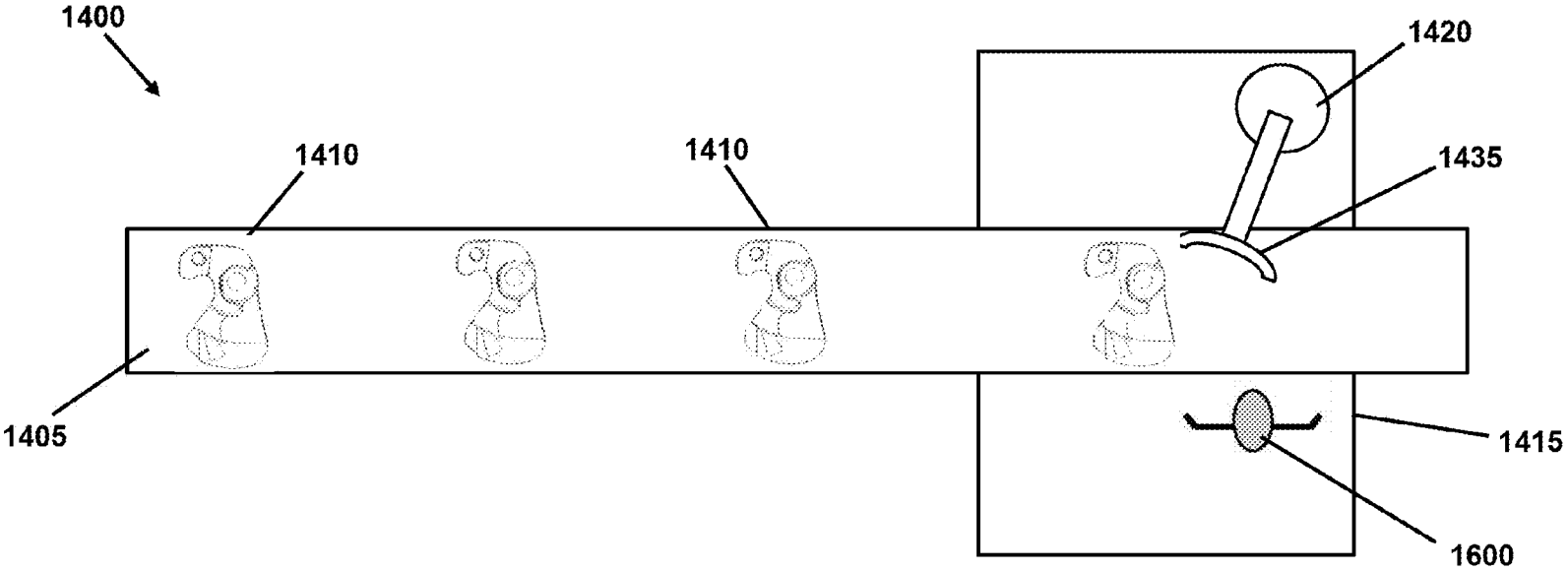
FIG. 25 schematically represents an alternative embodiment of the railcar knuckle shot-peening systems and processes of FIGS. 23*a*-23*b*, in which the respective multi-axis robot and fixed position shot-emitting device thereof have been replaced with a human operator.

FIG. 25 schematically represents an alternative embodiment of the railcar knuckle shot-peening systems and processes of FIGS. 23*a*-23*b*. In this embodiment, the shot-peening robot 1425 of the system of FIG. 23*a* and the fixed position shot-peening device 1455 of FIG. 23*b* are replaced with a human operator 1600. While not specifically shown in FIG. 25, the human operator 1600 would use a manually operable shot-emitting mechanism to shot peen areas of interest on a knuckle 1410 as the knuckle is presented to the operator by the part-handling robot 1420. Guarding, shielding and/or various other safety devices may be provided within the shot-peening area to protect the operator 1600 during the shot-peening process.

Figure 26A:
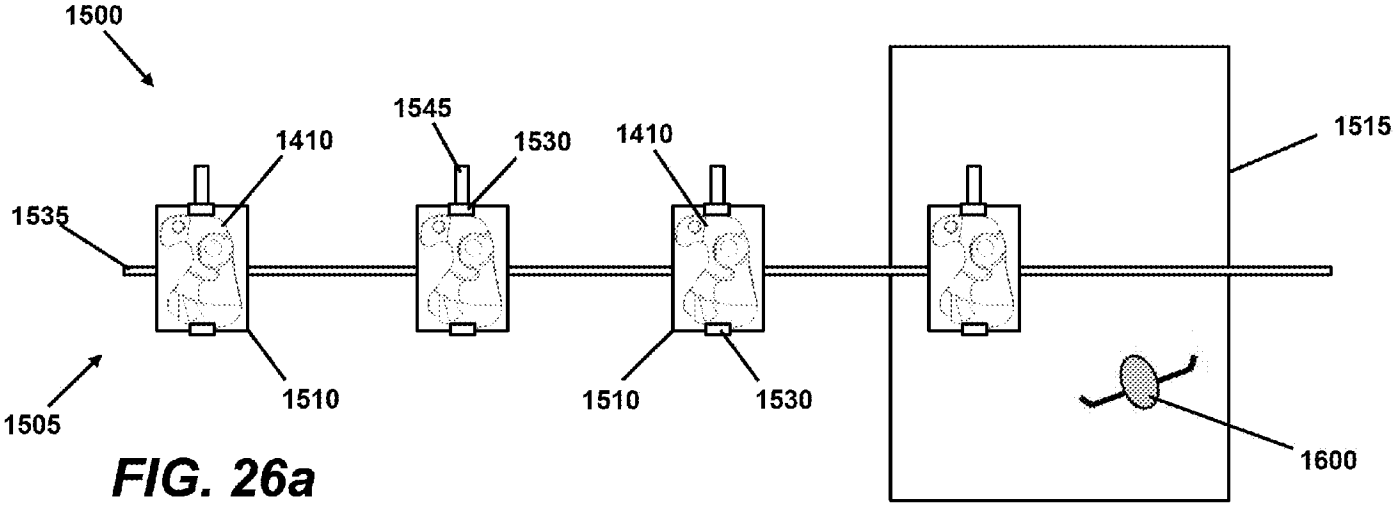
FIGS. 26*a*-26*b* schematically represent an alternative embodiments of the railcar knuckle shot-peening systems and processes of FIGS. 24*a*-24*b*, respectively, in which the respective multi-axis robot and fixed position shot-emitting devices thereof have been replaced with one or more human operators.

FIG. 26*a* schematically represents an alternative embodiment of the railcar knuckle shot peening system and process of FIG. 24*a*. In this embodiment, the shot-peening robot 1520 of the system 1500 of FIG. 24*a* is replaced with a human operator 1600. While not specifically shown in FIG. 26*a*, the human operator 1600 would use a manually operable shot-emitting mechanism to shot peen areas of interest on a knuckle 1410 as the knuckle is rotated through various orientations by an associated conveyor carrier 1510. Guarding, shielding and/or various other safety devices may again be provided within the shot-peening area to protect the operator 1600 during the shot-peening process.

Figure 26B:
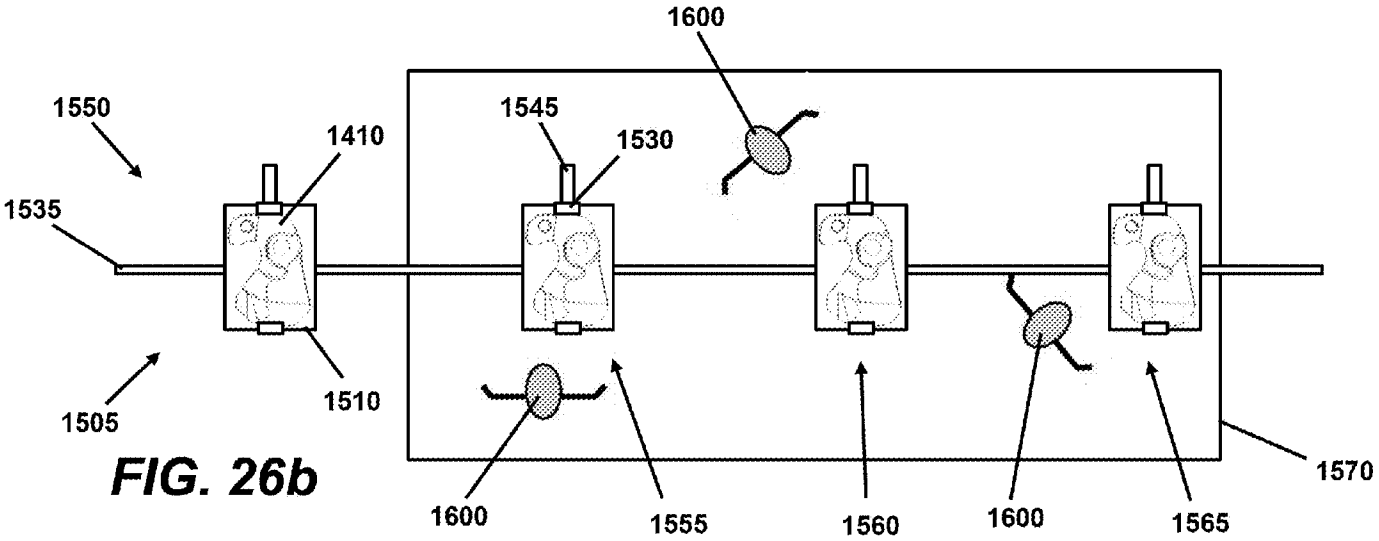

FIG. 26*b* schematically represents an alternative embodiment of the railcar knuckle shot peening system and process of FIG. 24*b*. In this embodiment, the fixed-position shot-peening devices 1575, 1580, 1585 of the system 1500 of FIG. 24*b* are replaced with a human operator 1600 who moves between the various shot-peening location 1555, 1560, 1565, or with a plurality of human operators, one of which is stationed at each of the various shot-peening locations. While not represented in FIG. 26*b*, it is also possible to use fewer human operators than the number of shot-peening locations present, such that one or more of multiple operators covers more than one location. For example, two operators may be used to cover the three shot-peening locations 1555, 1560, 1565 shown.

While not specifically shown in FIG. 26*b*, the human operator(s) 1600 would use a manually operable shot-emitting mechanism(s) to shot peen areas of interest on a knuckle 1410 as the knuckle is presented in various rotational orientations by an associated conveyor carrier 1510 at each shot-peening location 1555, 1560, and 1565. Guarding, shielding and/or various other safety devices may again be provided within the shot-peening area to protect the operator 1600 during the shot-peening process.

Figure 27:
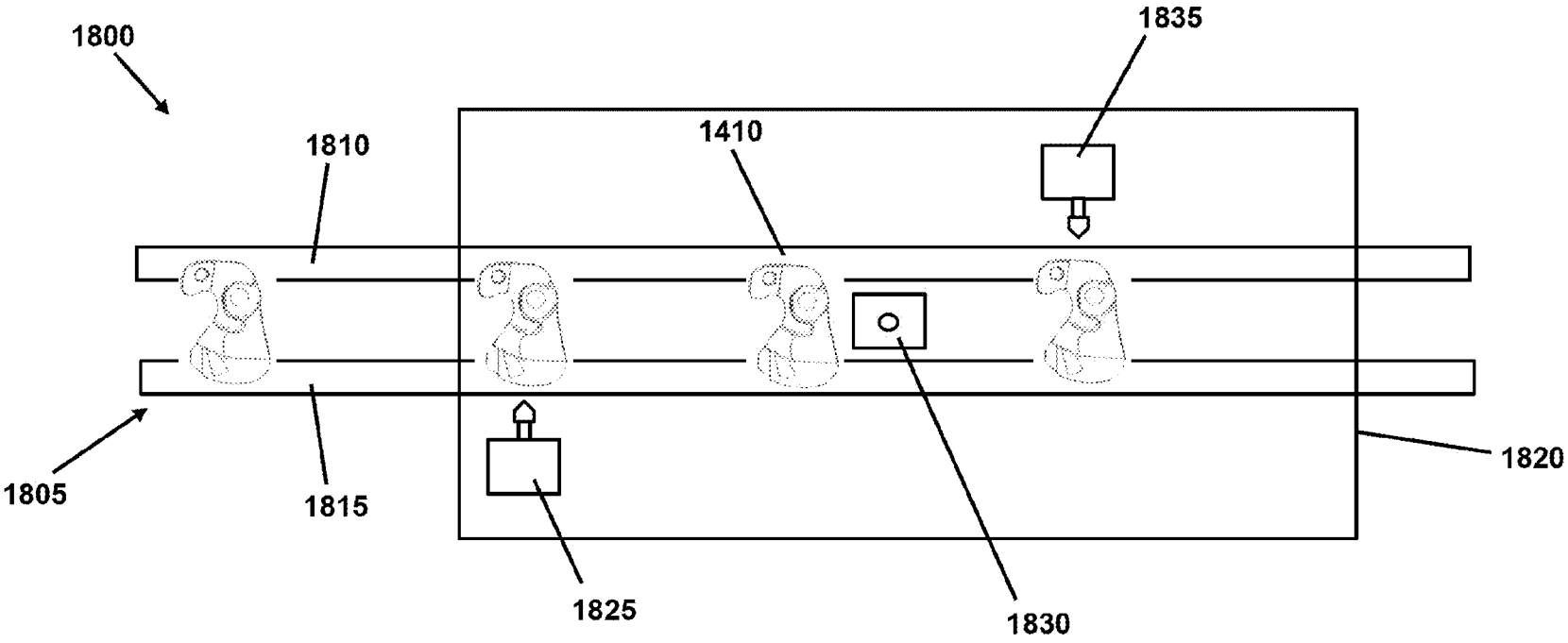
FIG. 27 schematically represents another alternative embodiment of a railcar knuckle shot-peening system and process whereby knuckles are transported through a shot-peening area on a specialized conveyor that leaves exposed the areas on the knuckle that are to be shot-peened.

Another exemplary embodiment of a railcar knuckle shot peening system 1800 and process is represented in FIG. 27. In this exemplary shot-peening system 1800, a conveyor 1805 includes two parallel but separate belts 1810, 1815 for transporting knuckles 1410 to a shot-peening area 1820. The belts may be driven in a linked manner to ensure proper movement of the knuckles 1410, as would be understood by one of skill in the art.

Knuckle supporting jigs or similar support elements (neither shown) that are designed to support and retain a knuckle 1410 through only limited points of contact, may be associated with and move with each conveyor belt 1810, 1815. Alternatively, a knuckle 1410 may rest directly on the conveyor belts 1810, 1815. In either case, areas of interest on the knuckle 1410 are preferably left as exposed as possible to facilitate the shot peening thereof.

The spacing between the conveyor belts 1410, 1415 allows one or more shot-peening devices 1830 to be positioned along the conveyor path and in the space between the belts for shot-peening one or more lower knuckle surfaces from below the knuckle 1410. In this particular version of such an embodiment, the areas of interest on the knuckle 1410 are shot peened by several individual fixed-position shot-peening devices 1825, 1830, and 1835. However, it should also be realized that robotic shot-peening devices may be substituted for some or all of the fixed-position shot-peening devices. In such a case, the shot peening robot(s) may again be a multi-axis robot(s) for maximized process flexibility and to reach into the space between the conveyor belts from one or angles.

In addition to the systems and processes represented by FIGS. 23*a*-27 it is also possible, depending on the design of a knuckle of interest and the areas thereof that are to be shot-peened, that a more simplistic shot-peening system may be employed. For example, it may be the case that all the areas of a given knuckle that are to be shot-peened may be accessible to a shot-peening device without any required rotation or other reorientation of the knuckle. In such a case, it may be possible to simply transport a knuckle to a shot-peening area in a single set position, where a shot-peening robot or one or more fixed-position shot-peening devices can be used to shot peen the various areas of interest. Such a system may resemble the systems of FIG. 23*a* or 23*b*, but without a need for the part-handling robot 1420.

Shot-peening systems of the invention, such as the exemplary systems shown in FIGS. 23*a*-27 and described above, may utilize various types of shot media, as long as the media can produce an acceptable amount of plastic deformation of the knuckle surface. For example, metallic, ceramic, or glass media may be used.

Embodiments of the invention may also employ multi-step shot peening, wherein the shot peening operation is a sequential process of shot peening with different media and/or media of different sizes. For example, shot peening with metallic media may be followed by shot peening with ceramic and/or glass media. Similarly, shot peening with media of a first size may be followed by shot peening with media of a smaller size, the second shot peening operation using media of the same or a dissimilar composition to that of the first shot peening operation. Shot peening processes of interest to the invention may be found, for example, in U.S. Pat. No. 7,946,009.

Figure 29:
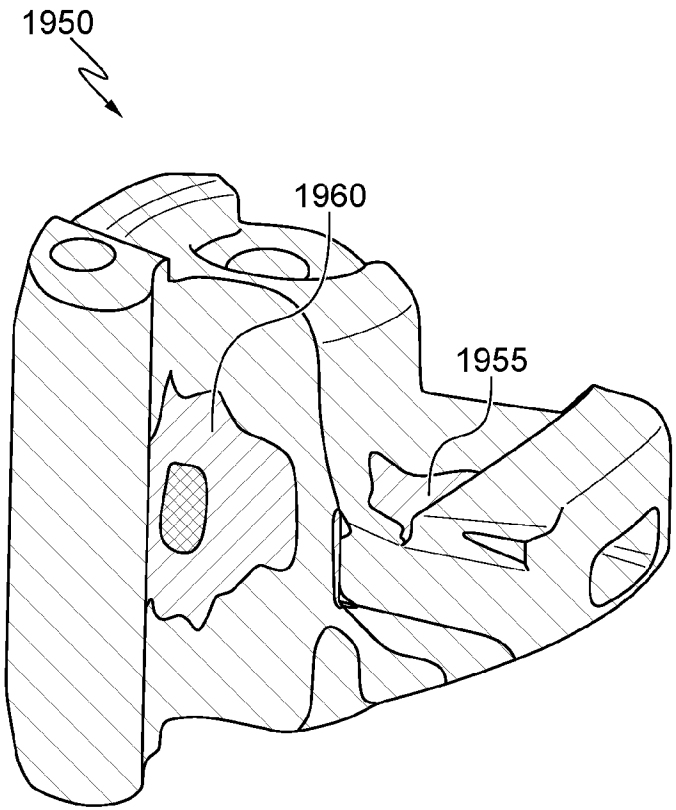
FIG. 29 is a FEA rendering of an exemplary railcar knuckle of the invention after shot peening.
Figure 28:
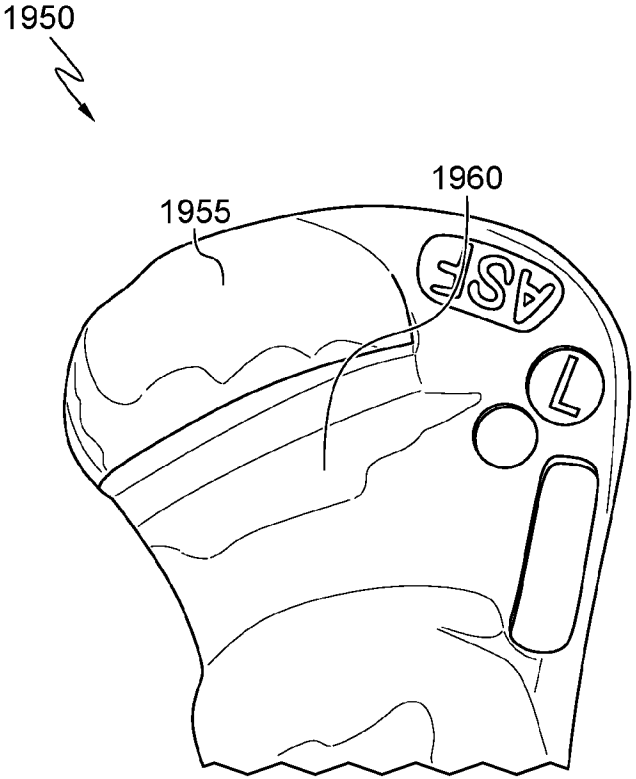
FIG. 28 illustrates a railcar after shot peening.

FIGS. 28-29 illustrate an exemplary railcar knuckle 1950 of the invention after shot peening in tail and throat areas 1955, 1960 thereof. In FIG. 28, a change in the surface of the knuckle 1950 in these areas is observable. FIG. 29 is a FEA rendering of the knuckle 1950 that shows a stress reduction in the shot-peened tail and throat areas 1955, 1960.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others ordinarily skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A method of improving a transportation coupling component's resistance to failure where said coupling comprises a plurality of surface areas, comprising the step of:

providing a sand mold having a plurality of surfaces;

forming said transportation coupling component using said mold;

improving a surface quality of at least one surface area of said transportation coupling component; and shot-peening at least one surface area of the coupling component to create a compressive surface layer on the coupling component.

2. The method of claim 1, wherein improving the surface quality of at least one surface area of said transportation coupling component comprises the steps of:

coating at least one surface of said sand mold with substances to improve the surface quality of the transportation coupling component, such substances comprising at least one of a Zircon, Chromite, or graphitic wash.

3. The method of claim 1, wherein the coupling component is a knuckle comprising surface imperfections and a pivot hole and improving the quality of the knuckle's surface area comprises the step of substantially removing the surface imperfections from a surface area of said knuckle by grinding, where the grinding operation is performed such that a grinding abrasive is applied to the surface of said knuckle such that resulting striation marks are aligned substantially perpendicular to said pivot hole.

4. The method of claim 1, where the at least one area includes a throat area of a knuckle.

5. The method of claim 1, where the at least one area includes a tail area of a knuckle.

6. The method of claim 1 where improving the quality of the coupling component's surface area comprises the steps of:

coating at least one area of the sand mold's surfaces with substances intended to reduce surface imperfections of the coupling component, such substances comprising at least one of a Zircon, Chromite, or graphitic wash; and removing imperfections from the surface of the coupling component by a grinding abrasive applied to the surface of the coupling component such that resulting striation marks are aligned substantially parallel to a direction of stress applied to the coupling component during an intended use of the coupling component.

7. The method of claim 1 wherein the coupling component is a railcar knuckle comprising metal walls subject to high levels of stress during a normal operation of the railcar knuckle and the method also comprises the step of modifying an internal structure of the knuckle to increase a wall thickness in such areas of high stress.

8. The method of claim 7, where modifying the internal structure of a knuckle comprises the step of:

increasing a wall thickness of the internal structure of the knuckle in an area of a pivot hole between a nose and a tail portion of the knuckle.

9. The method of claim 7, where modifying the internal structure of a knuckle comprises the step of:

increasing the thickness of the metal walls of the internal structure of the knuckle in a nose area of the knuckle.

10. The method of claim 9, where the step of increasing the thickness of the metal walls of the internal structure of the knuckle in the nose area of the knuckle comprises the substep of forming two internal voids in a mold core structure.

11. The method of claim 7, where modifying the internal structure of a knuckle comprises the steps of:

increasing a metal thickness of an upper and a lower wall of a tail section of the knuckle; and increasing a length of an internal support rib located between the upper and lower walls within the tail section of the knuckle.

12. The method of claim 1 wherein the coupling component is selected from a list comprising railcar knuckles, railcar yokes, and railcar coupler heads.

13. A shot-peening system for shot-peening one or more areas of a railcar knuckle subject to tensile stress when performing the intended coupling function of a railcar knuckle, the system comprising:

a conveyor for transporting a knuckle along a path;

a part-handling robot located along said path, the part-handling robot comprising retaining elements adapted to grasp a knuckle and present the knuckle in one or more orientations to a shot-peening device; and a shot-peening device located along said path, the shot-peening device equipped with a shot-emitting mechanism for impacting the knuckle with shot media.

14. The shot-peening system of claim 13, wherein the shot-emitting device is a multi-axis robot.

15. The shot-peening system of claim 13, wherein the shot-emitting mechanism is selected from one of an air blast system or a spinning centrifugal blast wheel.

16. A shot-peening system for shot-peening one or more areas on a railcar knuckle subject to tensile stress when performing the intended coupling function of a railcar knuckle, the system comprising:

a conveyor for transporting a knuckle along a path, the conveyor including a plurality of individual carriers that travel along a track along said path, each carrier equipped with rotatable knuckle retaining elements and means for rotating a retained knuckle for presentation to a shot-peening device; and at least one shot-peening device located in the shot-peening area, the shot-peening device equipped with a shot-emitting mechanism for impacting the knuckle with shot media.

17. The system of claim 16, wherein the means for rotating a retained knuckle is an electric motor.

18. The system of claim 16, wherein the means for rotating a retained knuckle includes one or more trip arms on the carrier and one or more trip dogs located along a path of travel of the conveyor.

* * * * *